US005423142A

United States Patent [19]

Douglas et al.

[11] Patent Number: 5,423,142

[45] Date of Patent: Jun. 13, 1995

[54] WEATHER-PROOF, VANDAL-PROOF, CHANGEABLE DISPLAY SIGN

[75] Inventors: Donald H. Douglas, Clinton; Stafford S. Cooper; Philip G. Malone, both of Vicksburg, all of Miss.

[73] Assignee: The United States of America as represented by the Secretary of the Army, Washington, D.C.

[21] Appl. No.: 138,029

[22] Filed: Oct. 19, 1993

[51] Int. Cl.[6] ..... G09F 7/00; G09F 7/02; G09F 7/22

[52] U.S. Cl. ..... 40/605; 40/611; 40/617; 40/618

[58] Field of Search ..... 40/605, 611, 617, 618

[56] References Cited

U.S. PATENT DOCUMENTS

| | | | |
|---|---|---|---|
| 1,455,474 | 5/1923 | Brown | 40/618 |
| 1,760,767 | 5/1930 | Muller | 40/605 |
| 1,852,028 | 4/1932 | Rowley | 40/617 |
| 2,171,462 | 8/1939 | Trollope et al. | 40/618 |
| 3,963,289 | 6/1976 | Pralle | 40/661 |
| 4,144,664 | 3/1979 | De Korte | 40/609 |
| 4,261,125 | 4/1981 | Rappaport | 40/367 |
| 4,434,570 | 3/1984 | Roos | 40/617 |
| 4,829,691 | 5/1989 | Manjos et al. | 40/661 |
| 4,930,235 | 6/1990 | Gillen et al. | 40/152 |
| 5,088,221 | 2/1992 | Bussiere et al. | 40/618 |
| 5,267,405 | 12/1993 | Seggerson | 40/618 |

*Primary Examiner*—Richard A. Bertsch
*Assistant Examiner*—Howard R. Richman
*Attorney, Agent, or Firm*—Luther A. Marsh

[57] ABSTRACT

An improved hanging display sign comprises boxes each having transparent face panels and a slot into which panels displaying letters are inserted to display a message. The letter panels are protected from inclement weather and from tampering by vandals by the transparent face panels and by sealing strips. A cable system is used to hold the boxes in a stack, with each box closing the opening in the top of the box below it. Drawing the cables tight holds the boxes together in a stack to form a weatherproof, vandal-proof display sign.

6 Claims, 3 Drawing Sheets

WEATHER-PROOF, VANDAL-PROOF, CHANGEABLE DISPLAY SIGN

GOVERNMENT INTEREST STATEMENT

The invention described herein may be manufactured, licensed, and used by or for governmental purposes without the payment of any royalties thereon.

I. BACKGROUND OF THE INVENTION

1. Field of Invention

This invention relates to an improved display sign. More particularly, it relates to a display sign which is protected against inclement weather and vandalism, whose message is easy to change, and which is easy to maintain.

2. Prior Art

Display signs, both indoors and outdoors, are widely built to accept letter panels which are slid into channels affixed to the face of the display, such channels holding the letter panels. These often are made of flexible plastic, and their resilience holds them in place between the channels. For elevated signs, the letter panels are usually lifted into place on poles and suspended by hooks on horizontal members affixed to the face of the display. The letter panels thus are exposed to the elements and to vandals. Illumination, by either incandescent or fluorescent lighting, is frequently provided behind the letter panels thus affixed to the face of the display sign.

Such display signs are frequently seen to be missing letters, either as a result of stormy weather or vandalism. Servicing of the lighting and changing the letters or designs of the panels is generally inconvenient.

U.S. Pat. No. 3,963,289 relates to a greeting card display having an enclosure formed of transparent front and side walls, the remaining walls being of translucent materials. Partitions are provided forming a pair of spaced receptacles. Holes are provided on the back wall for hanging the display on vertical surfaces.

U.S. Pat. No. 4,144,664 shows a weatherproof display consists of a thin rectangular box formed by two clear interlocking panels and a secured cap to enclose the top edges of the panels. A stand is provided for receiving the assembled panels.

U.S. Pat. No. 4,261,125 relates to a block wherein the front panel is transparent, which is backed by a loosely secured translucent panel for insertion of transparencies which are illuminated by a light on a back panel. Four plastic angle plates on the back panel press the translucent backing panel against the transparency.

U.S. Pat. No. 4,930,235 shows a cubic display device for children. Each face of the cube shows a picture and a telephone number to help a child associate the person pictured with that person's telephone number.

U.S. Pat. No. 4,829,691 relates to a display device for cards. A "holder and protector" resembling a bill fold is made of PVC plastic with two envelopes facing each other. The two envelopes are joined by a hinged connection so that they may be folded together and locked together.

The prior art does not address and solve the problems of outdoor sign displays. There is a need, therefore, for an improved display sign which is weather-proof, vandal-proof, and whose lighting equipment is easily accessible for servicing.

II. SUMMARY OF THE INVENTION

The improved display sign of this invention comprises one or more generally rectangular boxes each having at least one transparent face panel and a slot behind the face panel open on top for insertion of letter panel, displaying letters or symbols through the face panel of the box. Optionally, the letters may be backlighted by incandescent or fluorescent lighting elements placed inside the box, preferably behind the letter panel and connected by appropriate wiring to an external source of electric power. The letters or designs may be made of reflecting material such that illumination is not required for visibility. A plurality of boxes may be stacked vertically to provide several letter panels of multiple lines of message text, and the box or boxes may be supported singly or together, suspended by cables and pulleys through aligned openings on the bottom panels of each box. A sealing strip is provided at the bottom edge of the face panel so as to protect the slot of the box below it against filling up with rain water. In another embodiment, the stacked boxes may be held apart by means of interconnecting telescoping rods. The specific features and advantage of this invention will become apparent from the following detailed description with reference to the accompanying drawings.

III. BRIEF DESCRIPTION OF THE DRAWINGS

IV. DESCRIPTION OF PREFERRED EMBODIMENT OF THE INVENTION

Figure 1:
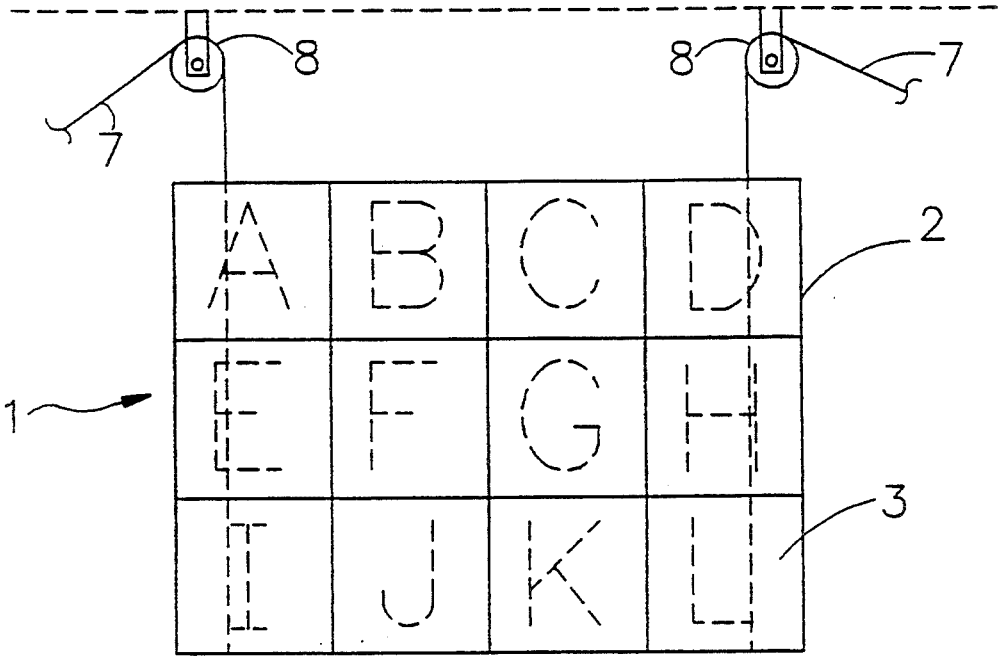
FIG. 1 is a front view of an embodiment of the improved display sign of this invention.
Figure 2:
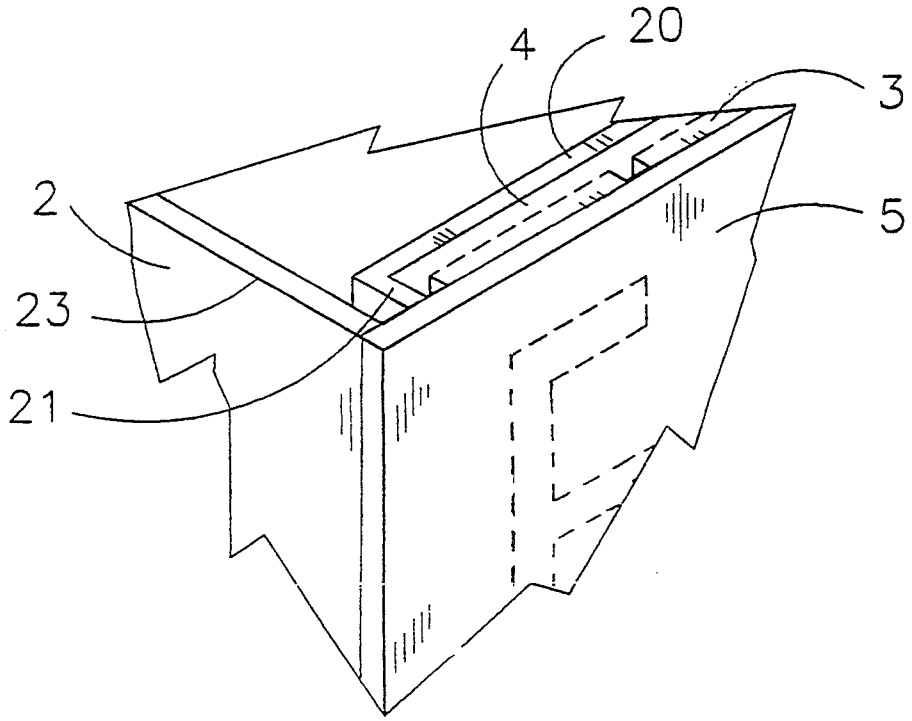
FIG. 2 is an isometric view illustrating a detail of the improved display sign of this invention showing the slot for holding sign panel.

With reference to FIG. 1, a display sign 1 comprises boxes 2 for holding letter panels 3 which are inserted into slots 4 as shown in FIG. 2. With further reference to FIG. 1, the boxes are stacked vertically to accommodate a sufficient number of letter panels for the text to be displayed. The dimensions of the boxes are determined by the size of lettering to be displayed and by the length of text to be displayed in each line of text. Logos and symbols may be displayed in addition to, or alternatively to, words or text, as will be obvious to those skilled in the art.

Each box has at least one face panel made of transparent or translucent material, e.g. polymethylmethacrylate, or Plexiglas (TM). The width of the panel is greater than its height or length. Should the box be used vertically, then the length of the panel would be greater than the width. The box has at least five panels. The face panel is transparent, and the other panels may be opaque or translucent. In the present embodiment, a top panel is not required since the bottom panel of the box above serves as a closure of the slot into which the letter panels are placed. The top box of a display may require a top panel for closure. Suspension cables 7 are provided to support the display sign from a support, such as a horizontal beam affixed to a pole, or a projection on the side of a building, or a hotel or theater marquee. Said support forms no part of this invention. Tension on the cables holds the boxes in close contact to prevent the loss of letter panels 3.

Figure 4:
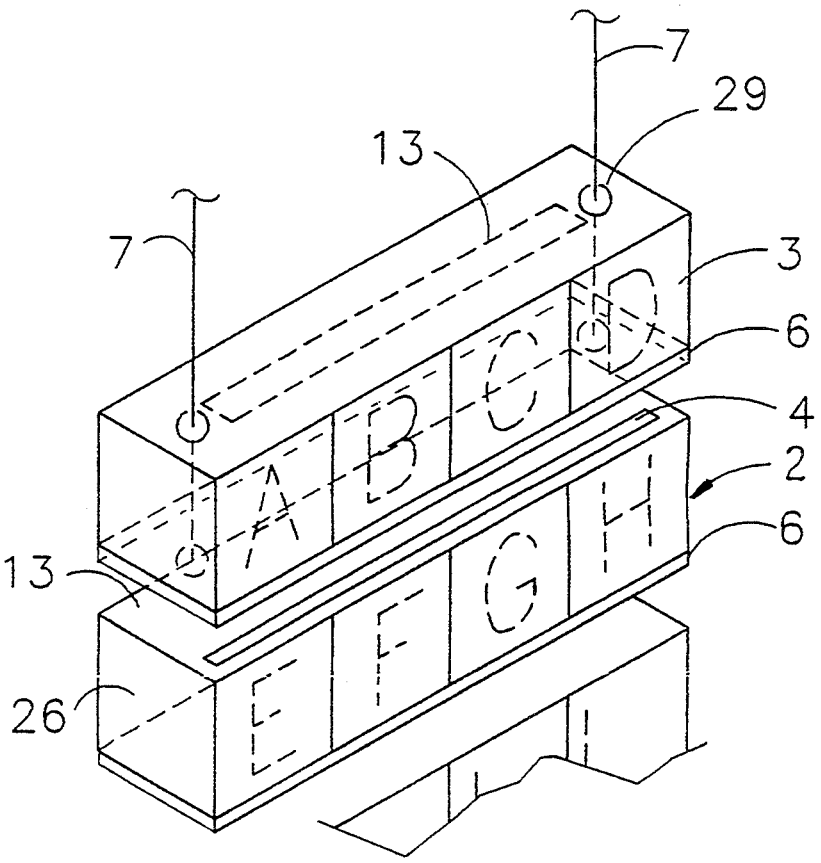
FIG. 4 is an isometric view of the improved display sign of this invention suspended from cables and illustrating the separation of the parts of the sign for changing letters and servicing the electric lighting.

Pulleys 8 are provided to allow the lowering of the display sign from an elevated position to the ground for servicing of electrical lighting and for changing letter panels when the message being displayed is to be changed. The suspension cables 7 are firmly attached to the lowest box, which supports all boxes above. The support cables pass through aligned holes 29, as shown in FIG. 4, two holes for the bottom panel of each box.

With reference to FIG. 2, the letter panels 3 are placed into a slot 4 behind a transparent or translucent face panel 5 which protects the letter panel from inclement weather and vandals.

Slot 4 is formed by a back panel 20 parallel to the face panel 5 but at a distance behind the face panel sufficient to accommodate the thickness of the letter panel 3. Two side arms 21 at a right angle to the back panel 20 may be glued or molded on to the back side of the face panel 5. Alternatively, the slot may be formed by bars affixed at a predetermined distance from and behind the face panel. In yet another embodiment, the width of panel 20 extends to both sides 23 of box 2, thereby eliminating the side arms 21. The details of the construction of the slot are not critical and are well known to those skilled in the art.

Figure 3:
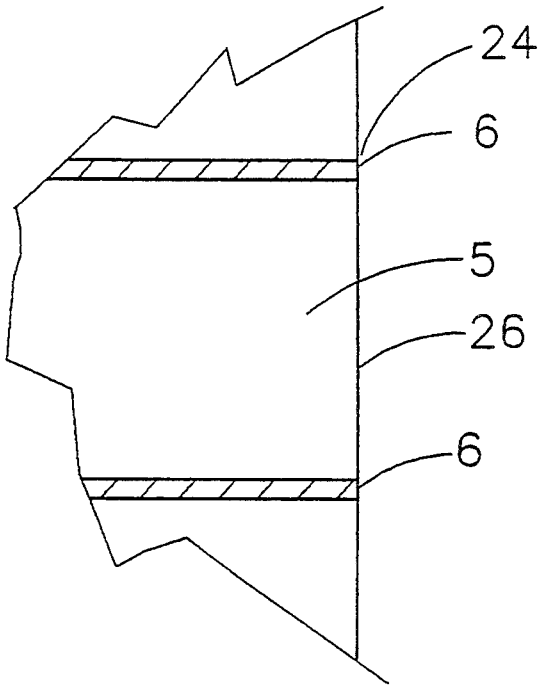
FIG. 3 is a front view of another detail of the improved display sign of this invention.

FIG. 3 illustrates the optional placement of sealing strips 6 along the bottom edge 24 of face panel 5 such that when the boxes are stacked, sealing strip 6 will seal the slot 4 of the lower box 2 to prevent the intrusion of rain water. The sealing strip may be cemented or molded on the lower edge of the face panel. Alternatively, the sealing strip may be replaced by a tongue-and-groove joint along the edges of the boxes.

Figure 6:
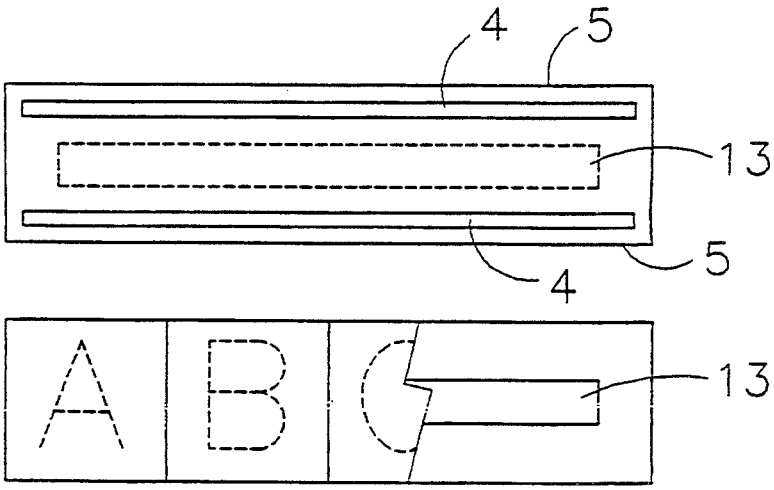
FIG. 6 shows a schematic cross-section of the display sign, looking downward, as well as a partially-cut front view of one of the boxes of the display sign with light fixture.

FIG. 4 shows the boxes 2 of the display sign lowered from their support and separated from each other in a position allowing the changing of letter panels 3 and servicing the electrical lighting elements 13 inside the boxes of the display sign through the top of the box, as shown in FIG. 6.

Figure 5:
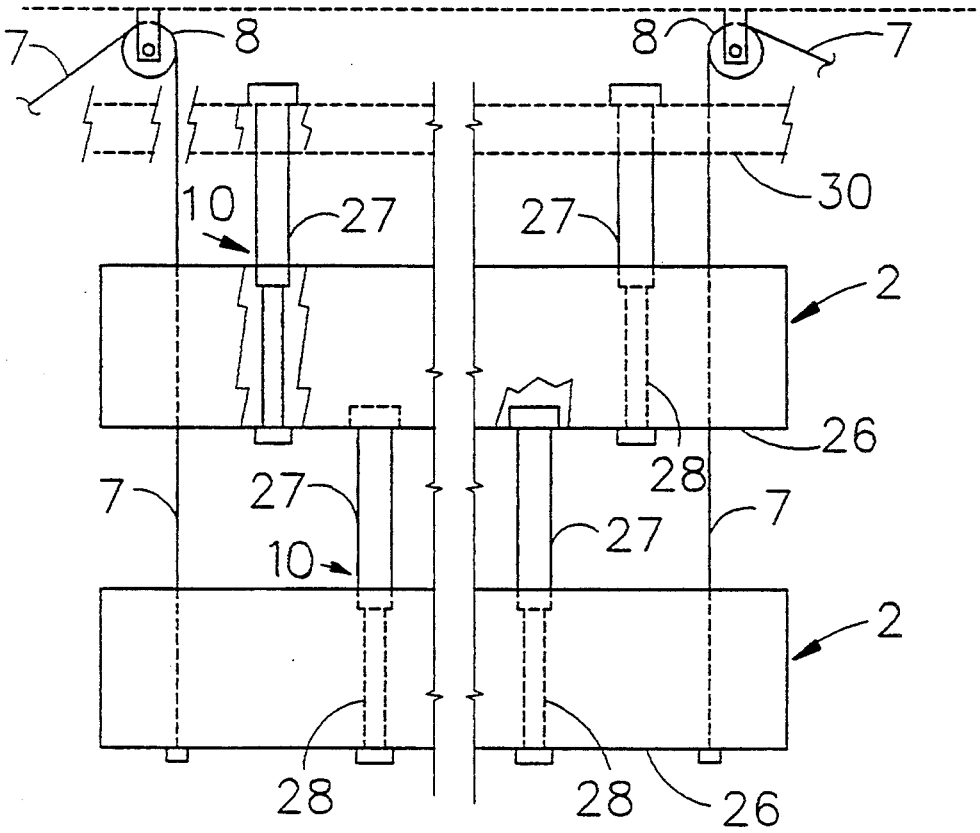
FIG. 5 is a front view of another embodiment of this invention illustrating an optional feature for supporting the boxes of the sign.

FIG. 5 illustrates an optional feature having telescoping rods 10 supporting and interconnecting the boxes 2 of the display sign while they are separated for servicing of the electric lighting elements and for changing the letter panels. Two telescoping rods spaced from each other connect each box at one end of each rod and the other ends with the box above it. The upper end of the outer tube 27 of the telescoping rod 10 is connected to the bottom panel 26 of the upper box, or the support beam 30 and the distal end of the inner rod 28 being connected to the bottom panel 26 of the lower box. When the suspension cables 7 are released, the inner rod of the telescoping rods slides out of the outer rod until it reaches a stop. The boxes are thus separated to a predetermined point but limited extent such that access to the letter panels is possible and that such letter panels can easily be removed and a new message assembled. Also, the electric lighting elements either suspended or attached within the box can be serviced, electric lightbulbs can be replaced, and electric wiring can be repaired or replaced as necessary.

When the suspension cables are tightened and the boxes raised, the inner telescoping rods slide into the outer telescoping rods. Alternatively, the cable connected to the pulley may provide stops (not shown) for the box to slide down to predetermined distance from each other.

FIG. 6 shows a schematic cross section of one of the boxes, looking downward, as well as a front view. It illustrates the position of the lighting element 13 behind two letter panels and transparent or translucent face panels 5 of the box so as to provide back lighting.

While this invention has been described as having a preferred design, it is understood that it is capable of further modifications, uses, and/or adaptations of the invention following in general the principle of the invention and including such departures from the present disclosure as come within the known or customary practice in the art to which the invention pertains and may be applied to the central features here set forth, and fall within the scope of the appended claims.

What is claimed is:

1. A display sign to be suspended from a support comprising:

a. a plurality of boxes, each box having at least five sides consisting of one face panel of transparent material, two side panels, two back panels and one bottom panel;

b. at least one back panel spaced from and directly behind the face panel, the two sides, the at least one back panel, and the face panel forming a slot for holding letter panels;

c. each box having an open top and a closed bottom;

d. two spaced apertures positioned on the bottom panel; and e. means for suspending and tensioning said sign through the spaced apertures from the support, wherein the means for suspending and tensioning seals the open top of each box.

2. The sign of claim 1, wherein the means for suspending and tensioning is a cable and pulley.

3. The sign of claim 1, further comprising two telescoping rods spaced from each other interconnecting said plurality of boxes, each box being stackable atop one another.

4. The sign of claim 3, further comprising a sealing strip affixed at a lower edge of each box, wherein the sealing strip prevents rainwater intrusion into each box stacked below said sealing strip.

5. A display sign to be suspended from a support comprising:

a. a box having at least five sides consisting of one face panel of transparent material, two side panels, two back panels and one bottom panel;

b. one of said back panels spaced from and directly behind the face panel, the two sides, the one of said back panels, and the face panel forming a slot for holding letter panels;

c. the box having an open top and a closed bottom;

d. two spaced apertures on said bottom panel; and e. means for suspending and tensioning said sign through the spaced apertures from the support, wherein said means for tensioning seals the open top of said box.

6. The sign of claim 5, wherein the means for suspending and tensioning is a cable and pulley.

* * * * *